US005331986A

United States Patent [19]

Lim et al.

[11] Patent Number: 5,331,986

[45] Date of Patent: Jul. 26, 1994

[54] DISHWASHING MACHINE

[75] Inventors: Moo-Seang Lim; Jong-Man Yun, both of Seoul; Chan-Kyu Park, Incheon; Sang-Dae Lee, Incheon; Sun-Chae Ma, Incheon; Seung-Seob Oh, Incheon; Eui-Sik Jeong, Incheon; Kwang-Sun Paek, Incheon, all of Rep. of Korea

[73] Assignee: Daewoo Eelctronics Company, Ltd., Seoul, Rep. of Korea

[21] Appl. No.: 24,158

[22] Filed: Mar. 1, 1993

[30] Foreign Application Priority Data

Sep. 4, 1992 [KR] Rep. of Korea ..... 92-16115

[51] Int. Cl.[5] ..... B08B 3/02

[52] U.S. Cl. ..... 134/88; 134/200; 134/201

[58] Field of Search ..... 134/56 D, 57 D, 58 D, 134/88, 200, 201, 115 R

[56] References Cited

U.S. PATENT DOCUMENTS 3,217,721 11/1965 Hertel ..... 134/58 D
3,288,154 11/1966 Jacobs ..... 134/58 D
3,586,011 6/1971 Mazza ..... 134/57 D
3,718,149 2/1973 Mazza ..... 134/57 D

FOREIGN PATENT DOCUMENTS 3337369 4/1985 Fed. Rep. of Germany ... 134/56 D
1080810 3/1984 U.S.S.R. ..... 134/56 D

*Primary Examiner*—Frankie L. Stinson
*Attorney, Agent, or Firm*—Willaim F. Pinsak

[57] ABSTRACT

A dishwashing machine is provided which comprises: a housing having a first washing compartment and a second washing compartment spatially separated from each other by a partition wall; first spray means for spraying the washing water onto the dishes within the first compartment; second spray means for spraying the washing water onto the dishes within the second compartment, the first and the second spray means operable independently of one another to permit selective washing of the dishes accommodated in the first and the second compartments; a drainpipe for allowing the washing water to be drained therethrough at the termination of an washing operation; and a multi-way valve, responsive to the particular mode of operation of the dishwashing machine for selectively coupling the pressurized washing water to the first spray means, the second spray means and the drain pipe.

9 Claims, 8 Drawing Sheets

FIG.4
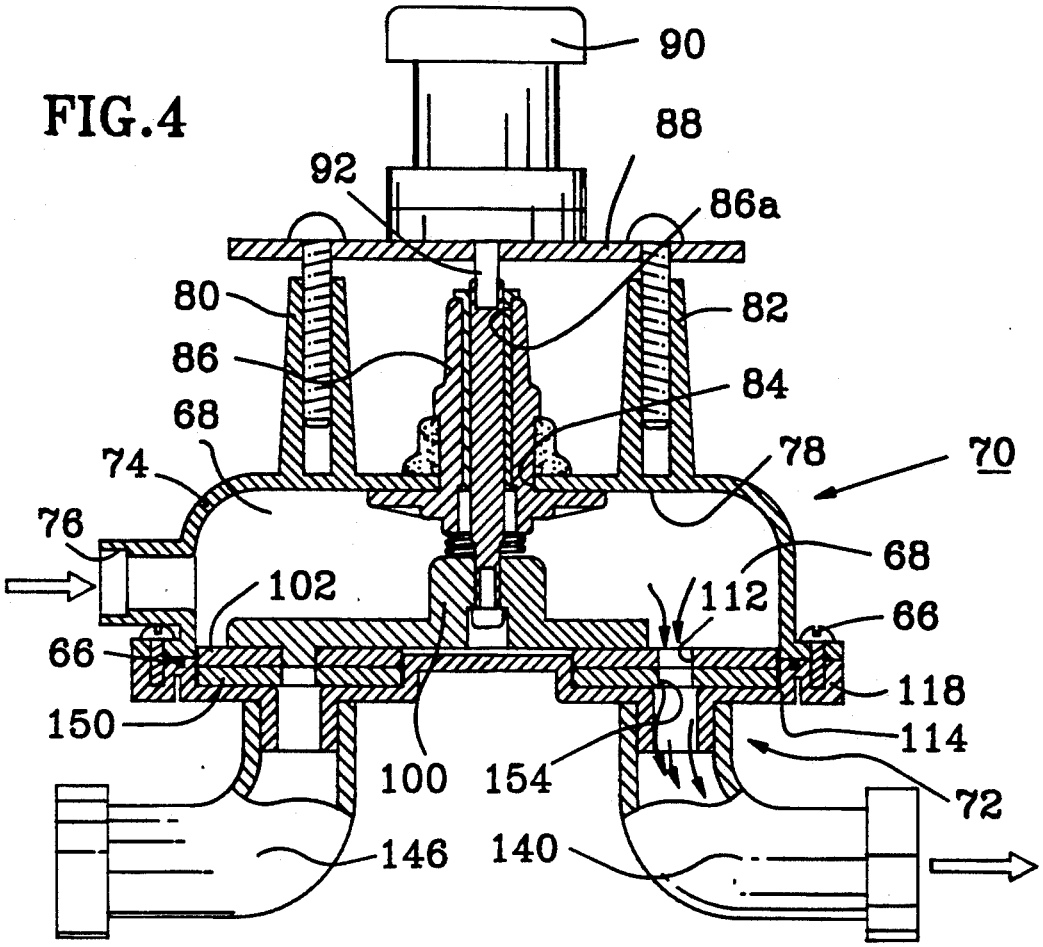
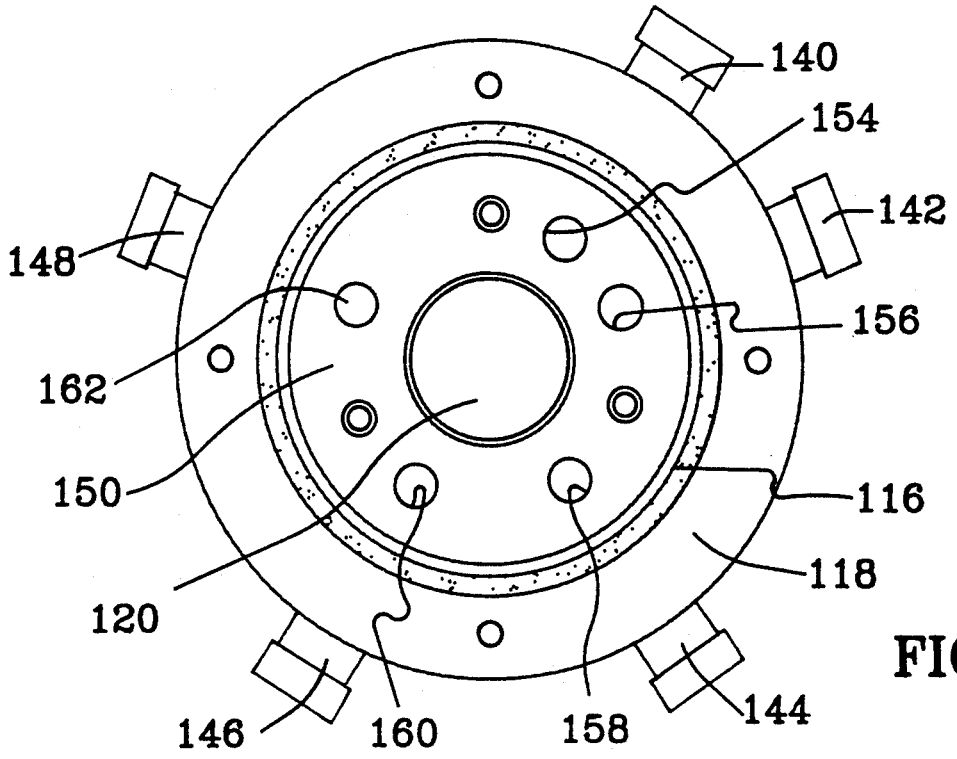
FIG.5

DISHWASHING MACHINE

FIELD OF THE INVENTION

The present invention pertains to a dishwashing machine of the type comprising an upper and a lower washing compartments that may be selectively or concurrently activated depending on whether the soiled dishes are received in only one compartment or both. The instant dishwashing machine includes a multi-way valve adapted to optionally direct the pressurized washing water from a fluid pump to one of several flow paths, depending on the operation mode or cycle of the machine at a given time. Additionally, the dishwashing machine embodying the present invention may comprise a washing aid supply unit which is capable of feeding a measured amount of detergent or sterilizing agent into the washing water in a fully automated fashion.

DESCRIPTION OF THE PRIOR ART

Conventionally, a variety of dishwashing machines are known in the art that can perform the washing or cleaning operation of soiled dishes housed in a washing room by way of spraying the washing water under pressure onto the dishes.

As a representative example, Korean Utility Model Publication No. 87-9576 discloses a dishwashing machine comprising a housing with a washing compartment, said washing compartment adapted to accommodate a couple of dish-carrying racks one above the other, a pair of upper and lower spray nozzles confronting each other in a spaced-apart relationship, a fluid pump for supplying washing water under pressure to the spray nozzles and a damper or three-way valve for periodically changing the washing water flow path to alternately feed the water to either the upper or the lower spray nozzle. In the dishwashing machine set forth above, a constant amount of the washing water is sprayed by means of the upper and the lower nozzles, regardless of the volume of the dishes to be washed, even when one of the dish-carrying racks is completely empty. This leads to an increased consumption of washing water, detergent, electric power and the like. Another disadvantage of the afore-mentioned dishwashing machine lies in that, in addition to the fluid pump for the washing water circulation, a separate drain pump is needed for the purpose of discharging the used water at the end of a washing or rinsing cycle, thus rendering the machine complicated in structure and costly to produce.

Japanese Patent Publication No. 89-23132 teaches a dishwashing machine specially designed for the easier removal of waste food left in the dishes, which comprises a housing having an upper washing compartment and a lower waste receiving compartment, an upper drawer slidably coupled into the washing compartment for accommodating the dishes in a readily removable condition, a lower drawer slidably fitted into the waste receiving compartment for receiving the waste dropped from the washing compartment and means for unlockably interlocking the upper drawer with the lower one to permit their movement in concert. While the dishwasher disclosed in the Japanese Patent Publication may be useful to certain extent in removing the waste food, it has a disadvantage in that the washing compartment tends to be severely restricted in its capacity to receive the dishes, due largely to the presence of the waste receiving compartment.

Japanese Patent Publication No. 76-42420 describes a fluid pump for use with a dishwashing machine, which comprises a casing having a first flow path connected to a spray nozzle and a second flow path connected to a drain pipe, an impeller rotatably mounted in the casing for feeding washing water under pressure to the first flow path when it rotates in the forward direction and to the second flow path when it rotates in the reverse direction and a valve, responsive to the machine operation mode, for closing one of the first and the second flow paths. With the fluid pump referred to above, there is no need to use a separate drain pump, which leads to a substantial reduction in the production cost and structural complexity of the dishwashing machine. It is apparent, however, that the prior art pump set forth immediately above cannot be used for the purpose of supplying the pressurized washing water to three or more of flow paths.

Korean Utility Model Publication No. 89-4411 teaches an automated detergent supply device comprising a detergent reservoir, a supply tube through which the detergent reservoir communicates with the washing compartment of a dishwashing machine and an electromagnetic valve positioned intermediately of the supply tube for controlling the amount of the detergent which is introduced into the washing compartment. While the detergent supply device referred to just above has an advantage of avoiding the manual supply of detergent each time a fresh washing cycle starts, it necessitates the use of a costly and less reliable electromagnetic valve.

U.S. Pat. No. 4,134,413 issued to Tore H. Noren on Jan. 16, 1979 discloses a tandem rack dishwashing machine which comprises means for quickly draining the used water into a waste water tank which then sends it to the sewer. The draining means makes it possible to rapidly drain the used water at the completion of a washing cycle and permits the waste water tank to deliver its water into the sewer at a lower speed while the dishwasher is washing a next set of soiled dishes. This reduces the time required between the draining of the washing water and the filling of the machine tank with the rinsing water. The dishwasher taught in the '413 patent is, however, so designed as to use a constant amount of washing water, even when the user desires to wash a small quantity of soiled dishes, thus resulting in an increased operation cost of the dishwasher. Further, the '413 patent does not mention how to supply a controlled amount of detergent into the washing water.

SUMMARY OF THE INVENTION

Accordingly, it is an object of the present invention to provide a dishwashing machine which substantially eliminates the shortcomings inherent in the prior art dishwashers, which can perform the washing operation of soiled dishes with a minimized consumption of electric power, washing water and washing aid, and which eschews the use of a separate draining pump.

Another object of the invention is to provide a multichannel valve for use with the dishwashing machine which is simple in structure, easy to fabricate and capable of selectively distributing the washing water under pressure to at least three outlet ports, depending on the operation mode of the dishwasher.

A further object of the invention lies in the provision of a washing aid supply unit which is able to feed an accurately measured amount of detergent or sterilizing agent into the washing water in a fully automated fashion without having to use any additional electrical drive means.

In accordance with the present invention, there is provided a dishwashing machine for the cleaning of soiled dishes with washing water, comprising: a housing having a first washing compartment and a second washing compartment spatially separated from each other by a partition wall; first spray means for spraying the washing water onto the dishes within the first compartment; second spray means for spraying the washing water onto the dishes within the second compartment, the first spray means operable independently of the second spray means to permit selective washing of the dishes accommodated in one of the compartments; a water holding tank underlying the first and the second compartments for receiving the washing water sprayed by the first and the second spray means; a drainpipe for allowing the washing water to be drained therethrough at the termination of a washing cycle; a fluid pump communicating with the water holding tank for drawing the washing water out of the tank to create pressurized washing water; and a multi-way valve, responsive to the operation mode of the dishwashing machine for selectively coupling the pressurized water to the first spray means, the second spray means and the drainpipe.

In a preferred embodiment, the multi-way valve comprises an upper casing having an inlet port connected to the fluid pump; a lower casing combined with the upper casing to form a fluid chamber therebetween, the lower casing having first to fifth outlet ports, the first outlet port connected to the first spray means, the second outlet port connected to the second spray means, the third outlet port connected to the drainpipe; a lower valve body fixedly mounted on the bottom of the lower casing, the lower valve body having first to fifth passage holes which coincide with the corresponding outlet ports of the lower casing; an upper valve body coming into frictional contact with the lower valve body for rotational movement with respect thereto, the upper valve body having an arcuate slot which is selectively registered with one or more of the passage holes of the lower valve body to establish a flow path for the pressurized washing water; and means responsive to the operation mode of the dishwashing machine for causing the upper valve body to rotate to a predetermined angular position.

Further, the inventive dishwashing machine may comprise a detergent supply device for feeding a measured amount of detergent into the washing water. Preferably, the device includes a detergent reservoir mounted on the top of the dishwashing machine, a washing water circulation pipe connected at one end to the fourth outlet port of the multi-way valve and at the other end to the water holding tank, a venturi tube forming an intermediate extension of the circulation pipe in the vicinity of the detergent reservoir, the venturi tube having a central bore of smaller diameter than that of the circulation pipe, and a flexible hose through which the detergent reservoir communicates with the central bore of the venturi tube. If desired, the dishwashing machine may additionally include a sterilizing agent supply device of substantially the same construction as that of the detergent supply device.

BRIEF DESCRIPTION OF THE DRAWINGS

The above and other objects and features of the present invention will become apparent from the following description of the preferred embodiments given in conjunction with the accompanying drawings, in which:

FIG. 4 is a cross-sectional view of the multi-way valve shown in FIG. 3.

FIG. 5 is a top view of the lower casing constituting a part of the multi-way valve;

DETAILED DESCRIPTION OF THE PREFERRED EMBODIMENTS

Figure 1:
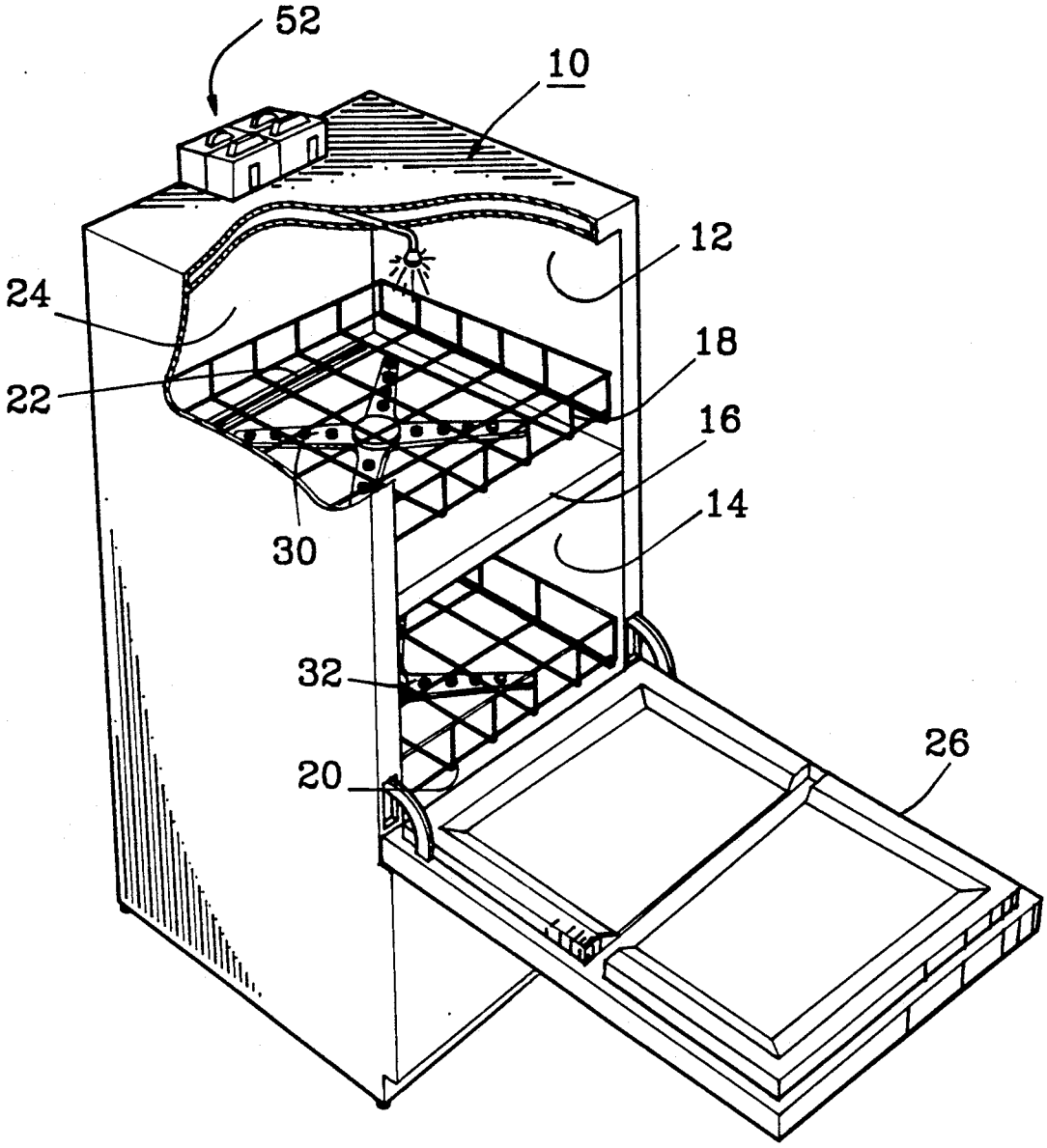
FIG. 1 is a partially cutaway perspective view of the dishwashing machine embodying the invention, with the door thereof in an open position.
Figure 2:
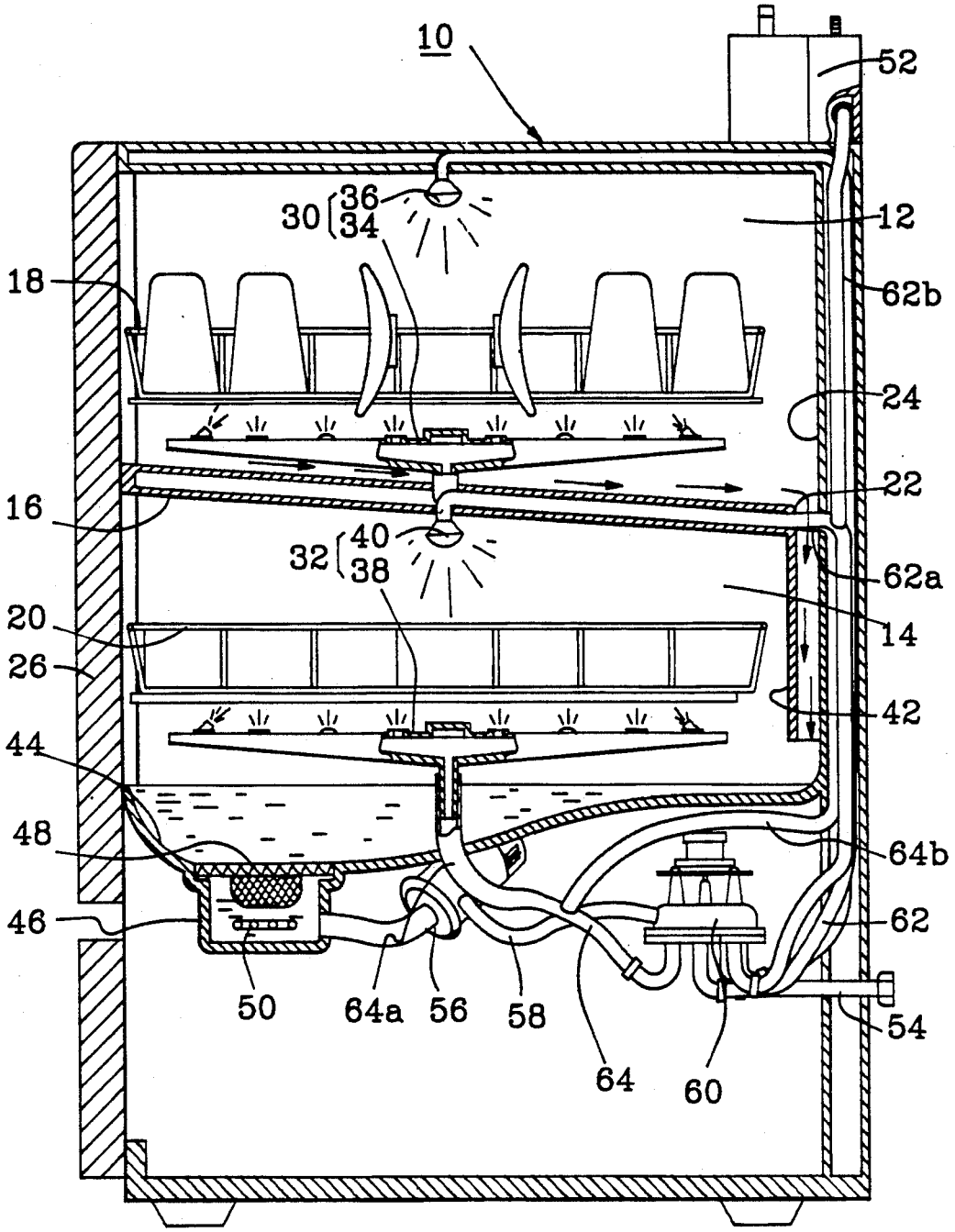
FIG. 2 shows a side elevational cross-section of the dishwashing machine depicted in FIG. 1.

Referring now to FIGS. 1 and 2, the dishwashing machine embodying the present invention comprises a housing or cabinet 10 which in turn includes a first washing compartment 12 and a second washing compartment 14 arranged one above the other. The first compartment 12 is spatially separated from the second compartment 14 by means of a partition wall 16. Each of the first and the second compartments 12 and 14 has a frontal opening that provides access to the interior of the first or second compartment 12 or 14. Positioned within the washing compartments 12 and 14 are dish-carrying racks 18 and 20 that may be slidably pushed into or taken out of the washing compartments 12 and 14 at the commencement or termination of a washing operation. The partition wall 16 is slanted downwardly toward the rear wall 24 of the housing 10 and has an elongate transverse slot 22 extending along the rear wall 24. The first washing compartment 12 communicates with the second washing compartment 14 through the transverse slot 22. Ideally, the slant angle of the partition wall is such that the wash water sprayed within the first compartment 12 may rapidly run down toward the rear wall 24 and then drained through the transverse slot 22 as quickly as possible. The frontal openings of the first and the second compartments 12 and 14 are openably closed by a door 26, the lower edge of which is hinged to the housing 10. It can be seen that the door 26 is in an open position in FIG. 1 to allow access to the first and the second compartments 12 and 14.

As clearly shown in FIG. 2, a first spray device 30 and a second spray device 32 are provided in the first and the second washing compartments 12 and 14 so that they can spray the wash water onto the soiled dishes supported on the dish-carrying racks 18 and 20. In the preferred embodiment, the first spray device 30 includes a revolvable spray arm 34 mounted on the bottom of the first compartment 12 for spraying the washing water onto the dishes in an upward direction and a spray nozzle 36 affixed to the ceiling of the first compartment 12 for spraying the washing water onto the dishes in a downward direction. Likewise, the second spray device 32 has a revolvable spray arm 38 and a spray nozzle 40 which are in an opposing relationship with each other. As will be set forth below, the first and the second spray devices 30 and 32 may be selectively operable so as to wash or clean the dishes accommodated in either the first or the second washing compartment 12 or 14.

Adjacent to the rear wall 24 of the housing 10 and within the second washing compartment 14, a guide plate 42 extends from the partition wall 16 toward the bottom of the second compartment 14. The guide plate 42 serves to ensure that the washing water flowing down from the first compartment 12 does not splash over the dish-carrying rack 20 located in the second compartment 14.

A water holding tank 44 underlying the first and the second compartments 12 and 14 is adapted to receive the washing water sprayed from the first and the second spray devices 30 and 32. The water holding tank 44 is provided with a sump 46 of bucket configuration, on the top edge of which a filter or strainer 48 is removably fitted to stop alien material, e.g., waste food particles from recirculation. If desired, a conventional heater 50 may be provided in the sump 46 for the purpose of elevating the temperature of the washing water to 140° F., for instance. About two gallons of the washing water may be fed into the water holding tank 44 so that the water level will be below the revolvable spray arm 38.

Mounted on the top of the housing 10 is a washing aid supply unit 52 which may be structurally or functionally divided into a detergent supply device and a sterilizing agent supply device. The washing aid supply unit 52 is adapted to feed, during the washing cycle, a measured amount of detergent e.g., liquid soap into the washing water to enhance the cleaning effect of the soiled dishes and, during the rinsing cycle, a measured amount of sterilizing agent, e.g., chlorine into the wash water. The washing aid supply unit will be described below in more detail with reference to FIGS. 7 to 10. At the completion of the washing cycle or the rinsing cycle, the used water gathered in the water holding tank 44 is drained through a drainpipe 54 to the sewer.

Coupled to the water holding tank 44 is a fluid pump 56 which functions to draw the wash water out of the tank 44 and then pressurize it to a predetermined pressure level. The washing water under pressure is supplied to a multi-way valve 60 through a communication pipe 58. The multi-way valve 60 is capable of selectively distributing the pressurized washing water to the first spray device 30, the second spray device 32, the washing aid supply device 52 and the drainpipe 54, depending on the operation mode of the dishwashing machine. As shown in FIG. 2, the multi-way valve 60 is connected to the first spray device 30 through a pipe 62 which consists of a main pipe portion **62*a* leading to the revolvable spray arm 34 and a branch pipe portion 62*b* leading to the spray nozzle 36. In addition, the multi-way valve 60 is connected to the second spray device 32 through a pipe 64. The pipe 64 is bifurcated to form a main pipe portion 64*a* leading to the revolvable spray arm 38 and a branch pipe portion 64*b* leading to the spray nozzle 40. Description will be given later on how to couple the multi-way valve with the washing aid supply unit 52**.

Figure 3:
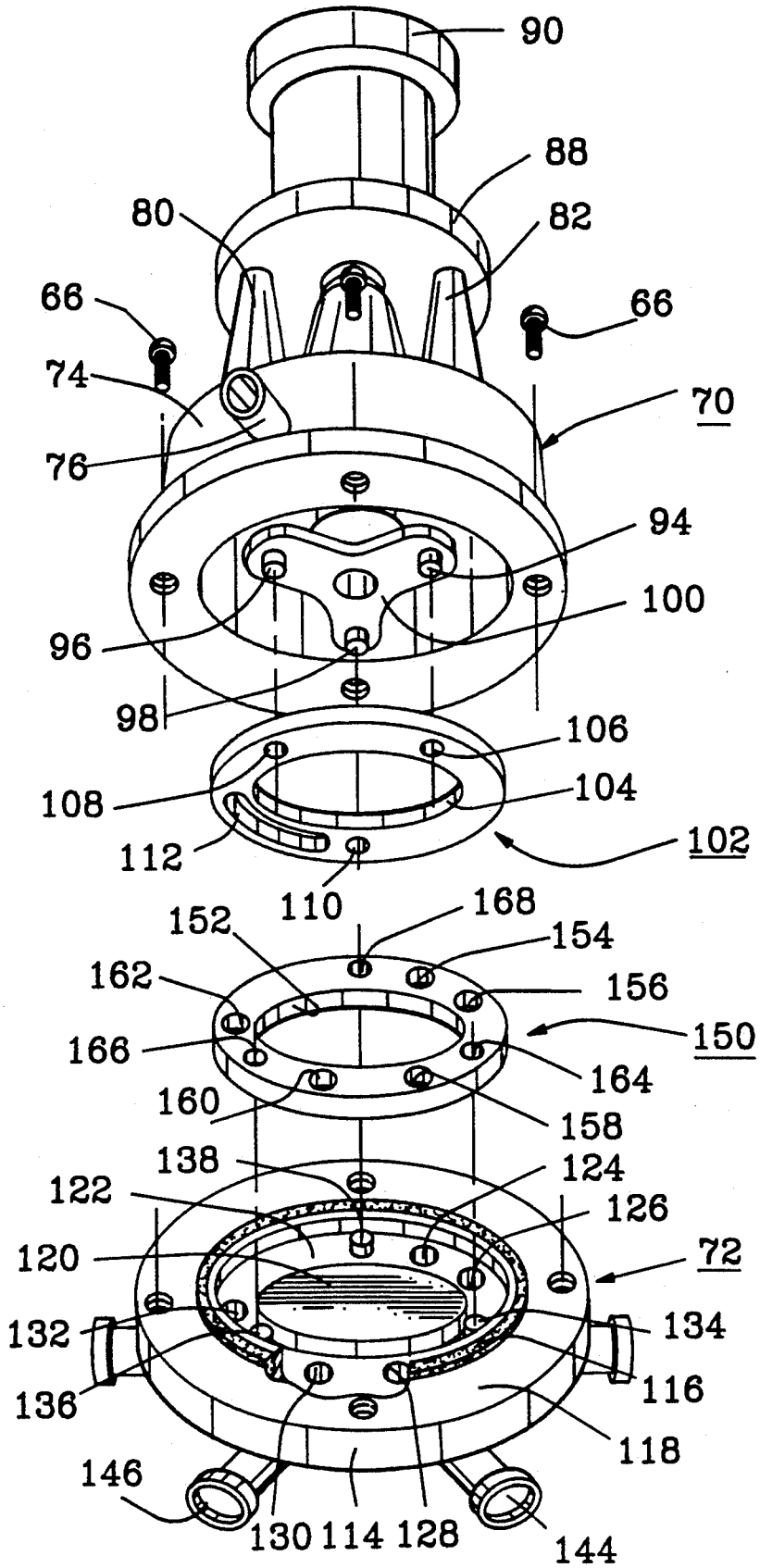
FIG. 3 is an exploded perspective view of the multi-way valve employed in the instant dishwashing machine.

Referring to FIGS. 3 to 5, it can be understood that the multi-way valve 60 comprises an upper casing 70 and a lower casing 72 which may be combined together in a fluid-tight manner by means of screws 66 to thereby define a fluid chamber 68 therebetween. The upper casing 70 has an inlet port 76 at its side wall 74 and a pair of bosses 80 and 82 extending upward from its top wall 78. Further, the upper casing 70 has a central aperture 84 through which a bushing 86 having an axial bore **86*a* is fitted tightly but removably. Secured to the free ends of the bosses 80 and 82 is a plate-like bracket 88 which in turn, supports a stepping motor 90 thereon. The stepping motor 90, which may be under control of an electronic controller (not shown), is provided with an output shaft 92 extending into the fluid chamber 68 through the axial bore 86*a* of the bushing 86. At its free end, the output shaft 92 carries a holder 100 having three vertical pins or posts 94, 96 and 98 on the downwardly faced surface thereof, each pins being angularly spaced apart from one another by about 120° The holder 100 serves to grip an upper valve body 102 of generally doughnut shape so that, when the stepping motor 90 is energized, the valve body 102 may be subject to rotational movement to a given angular position. As can be seen in FIG. 3, the upper valve body 102 has a central opening 104 of relatively larger diameter, three through-holes 106, 108 and 110 arranged in an equal angular spacing of about 120° for engagement with the corresponding pins 94, 96 and 98 of the holder 100 and an arcuate slot 112** extending an angular extent of, e.g., 36° along an imaginary circle.

The lower casing 72 of the multi-way valve 60 consists of a cylindrical side wall 114, a flange 118 extending radially outwardly from the top of the side wall 114, an annular seal ring 116 affixed on the flange 118 and a bottom wall 122 which has a central upright projection 120 extending in a vertically upward direction. On the bottom wall 122 of the lower casing 72, first to fifth outlet ports 124, 126, 128, 130 and 132 are formed at a predetermined angular spacing to allow passage of the pressurized washing water therethrough. Further, it can be seen that three vertical pins or posts 134, 136 and 138 project from the bottom wall 122 in an equal angular spacing of about 120° with respect to one another. In the embodiment shown in the drawings, the first outlet port 124 is angularly offset from the second outlet port 126 by 36°, while the second to fifth outlet ports 126, 128, 130 and 132 are arranged in an angular spacing of 72° to one another. It should be appreciated that the angular spacing stated above is not critical in the instant invention and, therefore, may be changed depending on the specific design of the multi-way valve.

Figure 7:
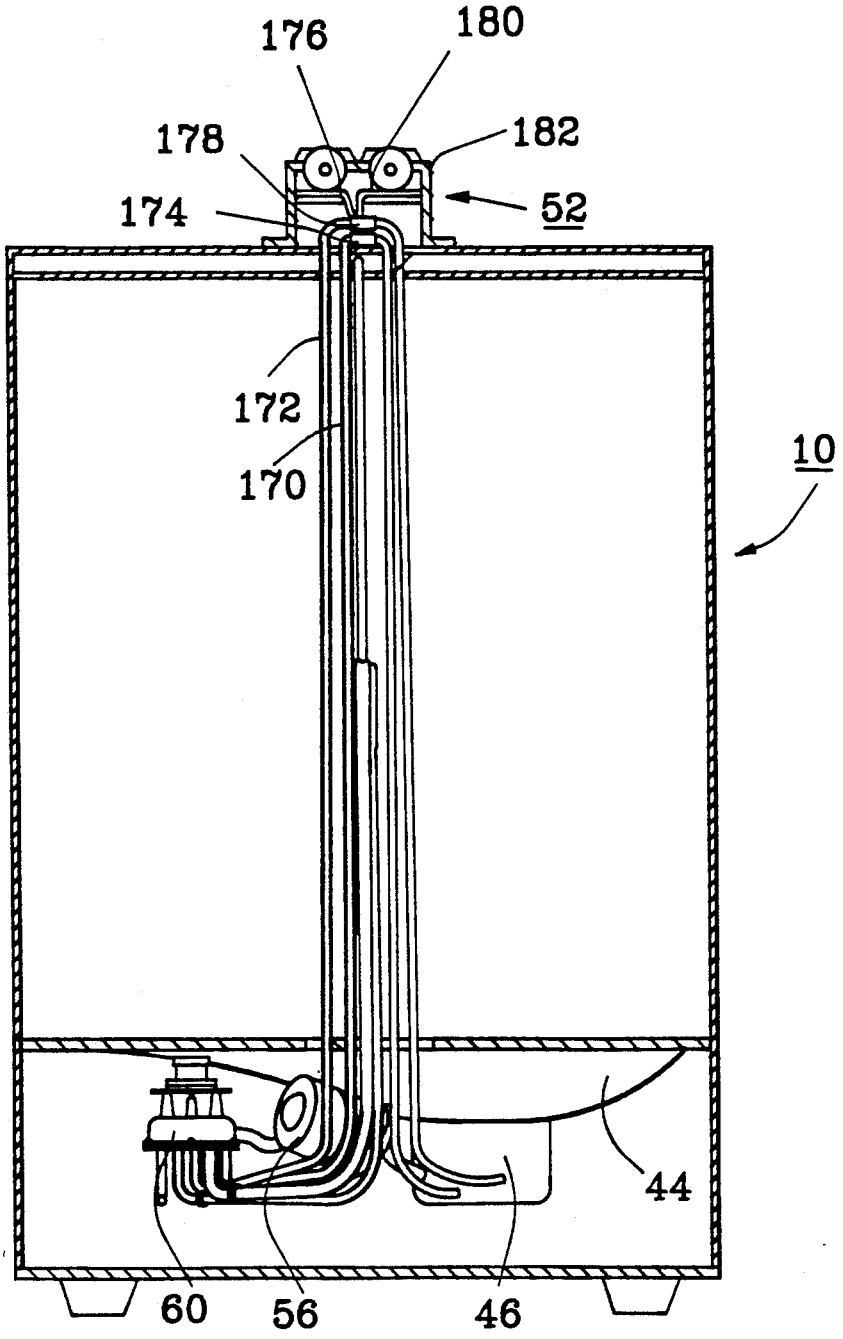
FIG. 7 is a rear cross-section of the dishwashing machine showing the multi-way valve which serves to distribute the pressurized washing water and further showing the washing aid supply device which is activated by the pressurized washing water flowing through the circulation pipe.

The lower casing 72 is further provided with first to fifth elbows 140, 142, 144, 146 and 148 each forming an extension of the first to fifth outlet ports 124, 126, 128, 130 and 132. In the preferred embodiment, the first elbow 140 is connected to the first spray device 30 through the pipe 62, as shown in FIG. 2, whereas the second elbow 142 is coupled to the second spray device 32 via the pipe 64. As best shown in FIG. 7, the third and the fourth elbows 144 and 146 are connected to a first washing water circulation pipe 170 and a second washing water circulation pipe 172, respectively, each of which leads to the water holding tank 44. The fifth elbow 148 is in a fluid communication with the drainpipe 54, as illustrated in FIG. 2. Alternatively, it may be possible to couple the third elbow 144 with the drainpipe 54, with the fourth and the fifth elbows 146 and 148 connected to the first and the second circulation pipes 170 and 172.

Turning back to FIG. 3, it can be seen that a lower valve body 150 of generally doughnut shape is fixedly placed on the bottom wall 122 of the lower casing 72 against any rotational displacement. As shown, the lower valve body 150 has a central opening 152 of relatively larger diameter, first to fifth passage holes 154, 156, 158, 160 and 162, each coinciding with the outlet ports 124, 126, 128, 130 and 132 of the lower casing 72 when the valve body 150 is held in position, and three equally spaced through-holes 164, 166 and 168 into which are inserted the corresponding posts 134, 136 and 138 of the lower casing 72. The lower valve body 150 of the above construction comes into frictional contact with the upper valve body 102 which may be rotated by the stepping motor 90 to a predetermined angular position. In response to energization of the stepping motor 90, the upper valve body 102 is subject to a rotational movement such that the arcuate slot 112 thereof may be selectively registered with one or more of the passage holes 154, 156, 158, 160 and 162 of the lower valve body 150. This will cause the pressurized washing water to flow out of the multi-way valve, as indicated by arrows in FIG. 4. Since the upper and the lower valve bodies 102 and 150 are in a frictional contact with each other, they should be preferably made of wear-resistant material, e.g., fine ceramics. Further, in order to avoid any washing water leakage between the upper and the lower valve bodies 102 and 150, each of the valve bodies should have an extremely smooth contact surface.

The operation of the multi-way valve will now be described with reference to FIGS. 6A to 6E in which the lower valve body 150 alone is depicted in a solid line, with the arcuate slot 112 of the upper valve body 102 shown in an imaginary line, for the sake of clarity.

Figure 6A:
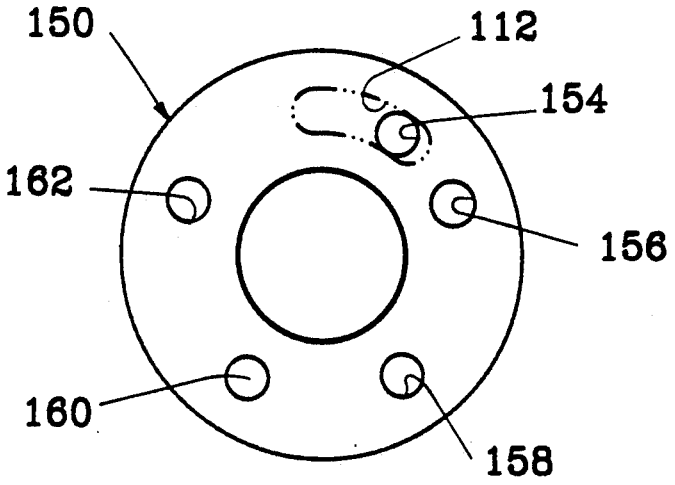
FIG. 6A is a schematic view showing the arcuate slot of the upper valve body which is registered with the first passage hole of the lower valve body so as to permit supply of the washing water to the first spray device.

Referring to FIG. 6A, it can be appreciated that the arcuate slot 112 of the upper valve body 102 is registered with the first passage hole 154 of the lower valve body 150. In that condition, the pressurized washing water is fed from the fluid pump 56 to the first spray device 30 via the first outlet port 124, the first elbow 140 and the pipe 62. In response, the first spray device 30 alone is operated to wash the dishes received within the first washing compartment 12. This is referred to as a "partial operation cycle" which may be advantageously employed to clean a small quantity of dishes at a time. During the partial operation cycle, the consumption of electric power, washing water and the like would be reduced to about one half, compared to the full operation cycle as set forth below.

Figure 6B:
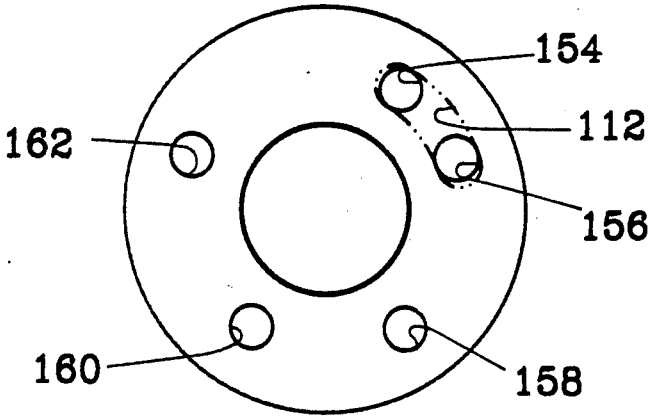
FIG. 6B is a view similar to FIG. 6A but showing the arcuate slot of the upper valve body which is in an alignment with both of the first and second passage holes of the lower valve body so as to permit supply of the washing water to the first and second spray devices in a simultaneous manner.

In FIG. 6B, the upper valve body 102 is caused to rotate by 36° in the clockwise direction so that the arcuate slot 112 may come into an alignment with both of the first passage hole 154 and the second passage hole 156 at the same time. Under that condition, the pressurized washing water is fed from the fluid pump 56 not only to the first spray device 30 via the first outlet port 124, the first elbow 140 and the pipe 62, but also to the second spray device 32 via the second outlet port 126, the second elbow 142 and the pipe 64, which permits concurrent washing of the dishes accommodated within the first washing compartment 12 and the second washing compartment 14. This is referred to as a "full operation cycle" which may be used in washing large quantity of the dishes at a time. Choice of the partial or full operation cycle depends on whether the soiled dishes are received in a single washing compartment or both.

Figure 6C:
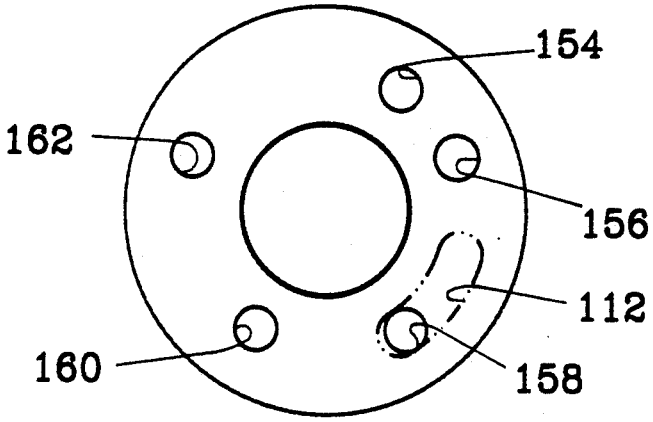
FIG. 6C shows the arcuate slot of the upper valve body coinciding with the third passage hole of the lower valve body so as to permit supply of the washing water to the first wash water circulation pipe.

Referring to FIG. 6C, the upper valve body 102 is caused to rotate by 72° in the clockwise direction so that the arcuate slot 112 can be in an alignment with the third passage hole 158 of the lower valve body 150. Under that condition, the pressurized washing water will flow through the third outlet port 128, the third elbow 144 and the first circulation pipe 170 before it returns to the water holding tank 44. As shown in FIG. 7, the first circulation pipe 170 has at its intermediate extension a first venturi tube 174 which communicates with a detergent reservoir of the washing aid supply unit 52 through a flexible hose 176. Accordingly, as the washing water flows through the first circulation pipe 170 during the washing cycle, the liquid detergent is drawn out of the detergent reservoir due to a so-called "venturi effect" and then mixed with the washing water. The washing aid supply unit 52 will be described below in more detail in conjunction with FIGS. 8 to 10.

Figure 6D:
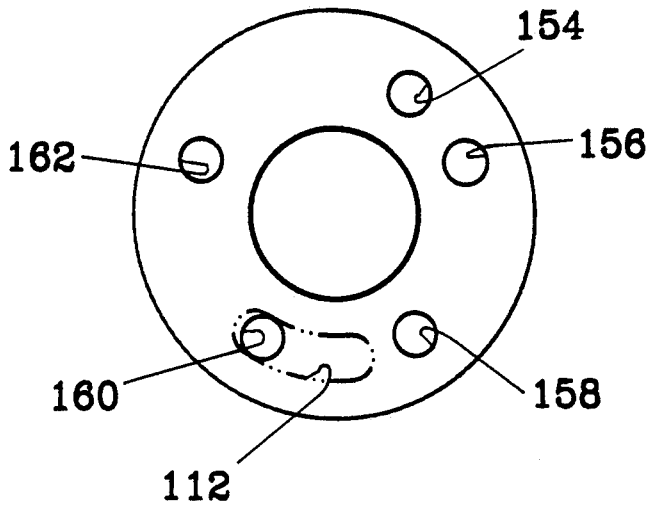
FIG. 6D illustrates the arcuate slot of the upper valve body coinciding with the fourth passage hole of the lower valve body so as to permit supply of the washing water to the second wash water circulation pipe.

Referring to FIG. 6D, the upper valve body 102 is shown to have been further rotated by 72° in the clockwise direction so that the arcuate slot 112 thereof can be in an alignment with the fourth passage hole 160 of the lower valve body 150. Under that condition, the pressurized washing water will flow through the fourth outlet port 130, the fourth elbow 146 and the second circulation pipe 172 in the named sequence, before it returns to the water holding tank 44. As clearly shown in FIG. 7, the second circulation pipe 172 has at its intermediate extension a second venturi tube 178 which communicates with a sterilizing agent reservoir of the washing aid supply unit 52 through a flexible hose 180. As a result, when the pressurized washing water flows through the second circulation pipe 172 during the rinsing cycle, the sterilizing agent of liquid phase is drawn from the sterilizing agent reservoir into the washing water by the venturi effect.

Figure 6E:
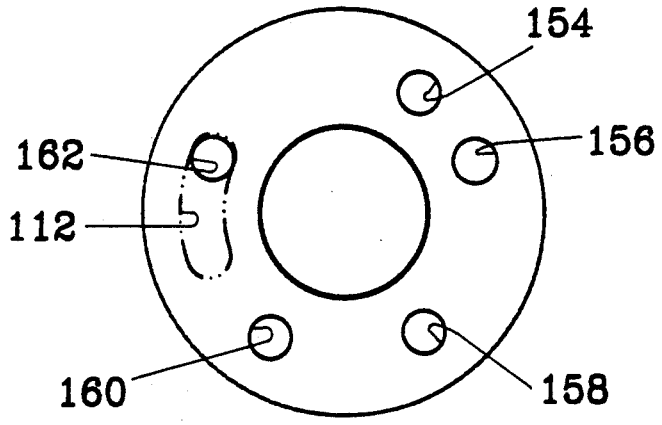
FIG. 6E depicts the arcuate slot of the upper valve body located in a final angular position wherein it coincides with the fifth passage hole so as to permit discharge of the used water to the sewer through the drainpipe.

In FIG. 6E, the arcuate slot 112 of the upper valve body 102 is shown to be in an alignment with the fifth passage hole 162 of the lower valve body 150, in which case the pressurized washing water is discharged to the sewer through the fifth outlet port 132, the fifth elbow 148 and the drainpipe 54. Such a drain operation will be carried out at each time when the washing or rinsing cycle is over.

Employing the multi-way valve 60 explained above would make it possible to optionally operate the first spray device 30, the second spray device 32 and the washing aid supply unit 52 through the use of a single fluid pump. Moreover, there is no need to employ a separate drain pump which has been normally required in the prior art dishwasher.

Figure 8:
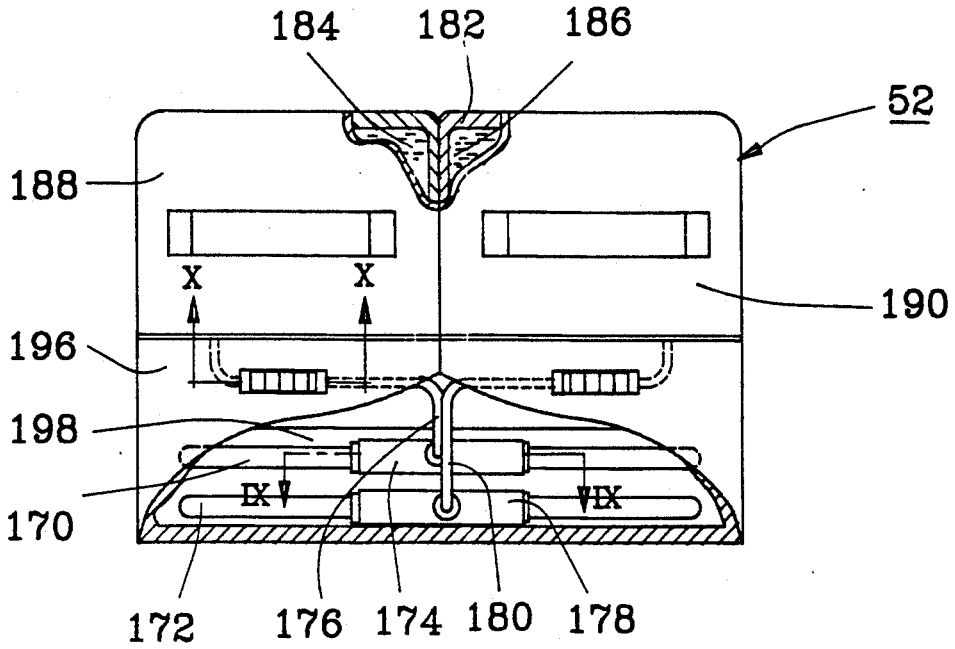
FIG. 8 is a top view of the washing aid supply device, with certain portions thereof removed for clarity.

The washing aid supply unit 52 will now be set forth in detail with reference to FIGS. 7 through 10. Referring first to FIGS. 7 and 8, the washing aid supply unit 52 includes a box-like housing 182 having a detergent reservoir 184 and a sterilizing agent reservoir 186 which are arranged in a juxtaposed relationship with each other. The detergent reservoir 184 serves to store a large quantity of liquid detergent e.g., liquid soap, whereas the sterilizing agent reservoir 186 contains a large quantity of liquid sterilizing agent such as chlorine, The reservoirs 184 and 186 are respectively covered with openable lids 188 and 190 that can be opened when the user desires to fill the reservoirs 184 and 186 with the detergent and/or the sterilizing agent. The detergent reservoir 184 is designed to communicate with the first venturi tube 174 through the flexible hose 176, whereas the sterilizing agent reservoir 186 is in a fluid communication with the second venturi tube 178 through the flexible hose 180.

Figure 9:
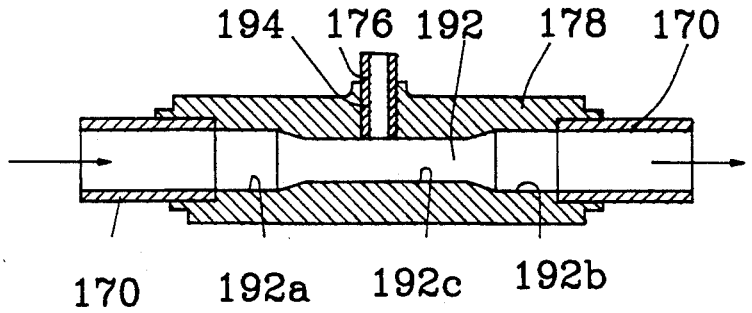
FIG. 9 is a cross-section taken along line IX—IX of FIG. 8, which illustrates the structural details of the venturi tube.

As shown in FIGS. 8 and 9, the detergent supply mechanism that constitutes a part of the washing aid supply unit 52 is provided with the first circulation pipe 170, the first venturi tube 174, the flexible hose 176 and the detergent reservoir 184. The first venturi tube 174 is of generally cylindrical shape and has a central bore 192 extending along the longitudinal axis of the tube 174 and an orifice 194 formed through the wall of the tube 174. Preferably, the central bore 192 consists of opposite marginal extensions 192*a* and 192*b* each having almost the same diameter as the external diameter of the first circulation pipe 170, and a cetral extension 192*c* having a smaller diameter than that of the marginal extensions 192*a* and 192*b*. The diameter of the central extension 192*c* is such that, as the pressurized washing water flows through the circulation pipe 170, the liquid detergent stored in the reservoir 184 may be drawn into the venturi tube 174, due to the pressure differential which may develop between the detergent reservoir 184 and the venturi tube 174.

Figure 10:
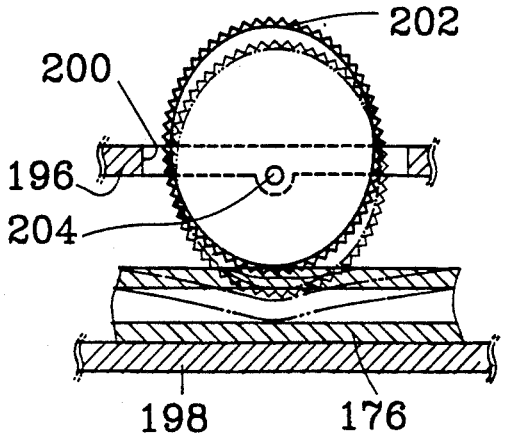
FIG. 10 is a cross-section taken along line X—X of FIG. 8, showing by way of example a device for manually regulating the flow rate of the detergent or sterilizing agent.

FIG. 10 illustrates by way of example a device for manually regulating the flow rate of the detergent which is fed into the washing water. As shown, the flexible hose 176 extends between a top plate 196 and a medial plate 198 of the housing 182. The top plate 196 has a rectangular slot 200 into which an eccentric pinch roller 201 is inserted and journalled in a manner that it can rotate about its pivot axis 202. It is preferred that the pinch roller 204 should have a knurled circumferential surface in order to increase frictional resistance thereof. When the pinch roller 204 is fitted into the rectangular slot 200, a portion of the pinch roller 204 is exposed to the outside so as to enable the user to rotate it manually. Further, the pinch roller 204 is adapted to come into frictional contact with the flexible hose 176 at its lowermost circumferential surface. The flexible hose 176 is preferably made of synthetic resin to ensure that, when depressed against the medial plate 198 by the pinch roller 204, the flexible hose 176 may be subject to an elastic deformation.

In operation, the pinch roller 204 is normally kept in an initial position, as indicated by a solid line in FIG. 10, wherein the flexible hose 176 does not suffer from any reduction in its cross-sectional area, thereby ensuring maximized flow rate of the liquid detergent. If the pinch roller 204 is manually rotated, for example, to the position indicated by a phantom line in FIG. 10, the flexible hose 176 will be pressed against the medial plate 198, which would correspondingly decrease the cross-sectional area of the hose 176 and hence the flow rate of the liquid detergent, due to the eccentricity of the pinch roller 204. What is set forth above in connection with the detergent supply mechanism also holds true for the sterilizing agent supply mechanism, the description of which is therefore omitted herein.

While the present invention has been shown and described with reference to the particular embodiments, it will be apparent to those skilled in the art that many changes and modifications may be made without departing from the spirit and scope of the invention as defined in the appended claims.

What is claimed is:

1. A dishwashing machine for use in cleaning soiled dishes with washing water, comprising:

a housing including a first washing compartment and a second washing compartment separated from each other by a partition wall;

first spray means for spraying the washing water onto the dishes within the first compartment;

second spray means for spraying the washing water onto the dishes within the second compartment, the first and the second spray means operable independently of one another to permit selective washing of the dishes accomodated in the first and the second compartments;

a water holding tank underlying the first and the second compartments for receiving the washing water sprayed by the first and the second spray means;

a drainpipe for allowing the washing water to be drained therethrough at the termination of a washing operation;

a fluid pump communicating with the water holding tank for drawing the washing water out of the tank to pressurize the washing water; and a multi-way valve, responsive to a particular mode of operation of the dishwashing machine for selectively coupling the pressurized water to the first spray means, the second spray means and the drainpipe, wherein the multi-way valve includes an upper casing having an inlet port connected to the pump; a lower casing combined with the upper casing to form a fluid chamber therebetween, the lower casing including first to third outlet ports, the first outlet port connected to the first spray means, the second outlet port connected to the second spray means, the third outlet port connected to the drainpipe; a lower valve body fixedly mounted on the bottom of the lower casing, the lower valve body having a plurality of passage holes which coincide with the corresponding outlet ports of the lower casing; an upper valve body coming into frictional contact with the lower valve body for rotational movement with respect thereto, the upper valve body having an arcuate slot which is selectively registered with one or more of the passage holes of the lower valve body to establish a flow path for the pressurized washing water; and means responsive to the operation mode of the dishwashing machine for causing the upper valve body to rotate to a predetermined angular position.

2. The dishwashing machine as recited in claim 1, wherein the partition wall of the housing extends rearwardly and downwardly at a predetermined angle and terminates at a transverse slot, the first compartment communicating with the second compartment through the slot.

3. The dishwashing machine as recited in claim 1, wherein each of the first and the second spray means comprises a revolvable spray arm positioned on the bottom of each of the first and the second washing compartments for spraying the washing water onto the dishes in an upward direction and a spray nozzle affixed to the ceiling of each of the first and the second washing compartments for spraying the washing water onto the dishes in a downward direction.

4. The dishwashing machine as recited in claim 1, wherein each of the upper and lower valve bodies is made of ceramic material and has a smooth contact surface.

5. The dishwashing machine as recited in claim 1, wherein the means for rotating the upper valve body comprises a stepping motor mounted outboard of the upper casing, a holder carrying the upper valve body thereon and a connecting rod for transmitting the rotational force of the stepping motor to the holder.

6. The dishwashing machine as recited in claim 1, wherein the lower casing of the multi-way valve includes a fourth outlet port, and further comprising a detergent supply device for feeding a measured amount of detergent into the washing water, the detergent supply device including a detergent reservoir mounted on the top of the dishwashing machine, a washing water circulation pipe connected at one end to the fourth outlet port of the multiway valve and at the other end to the water holding tank, a ventri tube forming an intermediate extension of the circulation pipe in the vicinity of the detergent reservoir, the venturi tube having a central bore of smaller diameter than that of the circulation pipe, and a flexible hose through which the detergent reservoir communicates with the central bore of the venturi tube.

7. The dishwashing machine as recited in claim 6, wherein the detergent supply device further includes means for changing the cross-sectional area of the flexible hose to thereby regulate the amount of the detergent which is fed into the washing water.

8. The dishwashing machine as recited in claim 1, wherein the lower casing of the multi-way valve includes a fifth outlet port, and further comprising a sterilizing agent supply device for feeding a measured amount of sterilizing agent into the washing water, the sterilizing agent supply device including a sterilizing agent reservoir mounted on the top of the dishwashing machine, a washing water circulation pipe connected at one end to the fifth outlet port of the multi-way valve and at the other end to the water holding tank, a venturi tube forming an intermediate extension of the circulation pipe in the vicinity of the sterilizing agent reservoir, the venturi tube having a central bore of smaller diameter than that of the circulation pipe, and a flexible hose through which the sterilizing agent reservoir communicates with the central bore of the venturi tube.

9. The dishwashing machine as recited in claim 8, wherein the sterilizing agent supply device further includes means for changing the cross-sectional area of the flexible hose to thereby regulate the amount of the sterilizing agent which is fed into the washing water.

* * * * *